US012768124B2

(12) United States Patent
Bowsher et al.

(10) Patent No.: US 12,768,124 B2
(45) Date of Patent: Oct. 20, 2026

(54) MANHOLE COVER

(71) Applicant: Star Pipe Products, LP, Houston, TX (US)

(72) Inventors: Mark Bowsher, Glen Haven, CO (US); Jade Komolaputr, Houston, TX (US)

(73) Assignee: Star Pipe Products, LP, Houston, TX (US)

( * ) Notice: Subject to any disclaimer, the term of this patent is extended or adjusted under 35 U.S.C. 154(b) by 139 days.

(21) Appl. No.: 18/763,466

(22) Filed: Jul. 3, 2024

(65) Prior Publication Data

US 2026/0009199 A1 Jan. 8, 2026

(51) Int. Cl.
*E02D 29/14* (2006.01)

(52) U.S. Cl.
CPC ..... *E02D 29/1463* (2013.01)

(58) Field of Classification Search
CPC ..... E02D 29/14; E02D 29/1463
See application file for complete search history.

(56) References Cited

U.S. PATENT DOCUMENTS 1,923,481 A * 8/1933 Ford ..... G01F 15/14 292/241
3,130,651 A * 4/1964 Werner ..... E02D 29/14 49/389
4,508,469 A * 4/1985 Dumortier ..... E02D 29/1463 404/25
4,840,514 A * 6/1989 Defrance ..... E02D 29/14 404/25
5,017,039 A * 5/1991 Spiess ..... E03F 5/06 404/25
5,937,583 A * 8/1999 Lamperti ..... E02D 29/1418 49/386
6,749,363 B1 * 6/2004 Petersen ..... E02D 29/14 404/25
7,216,459 B1 * 5/2007 Akkala ..... E05F 1/1016 49/386
2006/0245829 A1 * 11/2006 Akkala ..... E02D 29/1463 404/25
2007/0186381 A1 * 8/2007 Monneret ..... E02D 29/1418 16/267
2010/0012671 A1 * 1/2010 Vrondran ..... F41H 5/223 52/20
2012/0020728 A1 * 1/2012 Royer ..... E02D 29/1463 16/250

(Continued)

*Primary Examiner* — Paola Agudelo
(74) *Attorney, Agent, or Firm* — Crowe & Dunlevy, P.C.

(57) ABSTRACT

A closure assembly includes a frame, a cover, and a hinge assembly. The hinge assembly selectively connects the frame to the cover to allow rotation between an open position and a closed position. The hinge assembly includes at least one tine formed on an edge of the cover, a projection extending from the at least one tine, at least one wall formed on an upper surface of the frame, and a slot formed in the at least one wall that receives the projection. The slot includes a rotation section, an opening radiating from the rotation section, and a locking section radiating from the rotation section. The locking section allows the cover to rotate to an angle greater than ninety degrees when the projection is at least partially in the locking section. The locking section and the opening have a non-180 degree angular offset relative to one another.

13 Claims, 4 Drawing Sheets

(56) References Cited

U.S. PATENT DOCUMENTS

| | | | | |
|---|---|---|---|---|
| 2013/0071183 | A1* | 3/2013 | Vrondran | E02D 29/1463 404/25 |
| 2014/0123560 | A1* | 5/2014 | Boca | E02D 29/14 49/394 |
| 2019/0010674 | A1* | 1/2019 | Choi | E02D 29/1436 |
| 2024/0240424 | A1* | 7/2024 | Cathey | E02D 29/1418 |

* cited by examiner

MANHOLE COVER

CROSS-REFERENCE TO RELATED APPLICATIONS

This patent application takes priority from U.S. provisional patent application Ser. No. 63/524,821 filed on Jul. 3, 2023.

BACKGROUND OF THE DISCLOSURE

1. Field of Disclosure

The present disclosure relates to covers for openings into underground spaces.

2. The Related Art

A manhole cover is a round or rectangular plate that is used to cover openings in the ground, typically found on streets, sidewalks, or other paved surfaces. It provides access to underground utility networks such as sewers, storm drains, electrical or telecommunications cables, or other infrastructure. Manhole covers are typically made of durable materials such as cast iron, ductile iron, or reinforced concrete, which allow them to withstand heavy loads and protect the underground infrastructure from damage. They are designed to be heavy and sturdy, preventing unauthorized access or accidental falls into the underground chambers.

SUMMARY OF THE DISCLOSURE

In aspects, the present disclosure provides a closure assembly that includes a frame, a cover, and a hinge assembly. The hinge assembly selectively connects the frame to the cover and allows the cover to rotate between an open position and a closed position. The hinge assembly may include at least one tine formed on an edge of the cover, a projection extending from the at least one tine, at least one wall formed on an upper surface of the frame, and a slot formed in the at least one wall and configured to receive the projection, wherein the slot includes a rotation section, an opening radiating from the rotation section, and a locking section radiating from the rotation section. The locking section may be configured to allow the cover to rotate to an angle greater than ninety degrees when the projection is at least partially in the locking section. The locking section and the opening may have a non-180 degree angular offset relative to one another.

In aspects, the present disclosure provides a closure assembly that includes a frame, a cover, and a hinge assembly. The hinge assembly selectively connects the frame to the cover and allows the cover to rotate between an open position and a closed position. The hinge assembly may include a first and a second tine formed on an edge of the cover, a projection extending from each of the first tine and the second tine, a first and a second wall formed on an upper surface of the frame, and a slot formed in the each of the first wall and the second wall, wherein each slot includes an opening, rotation section, and a locking section. Each opening may be configured to allow passage of the associated projection into and out of the associated rotation section. Each rotation section may be configured to allow rotation of the associated projection.

The above-recited example of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the described embodiments, taken in conjunction with the accompanying drawings listed below.

DETAILED DESCRIPTION OF THE DISCLOSURE

Figure 1:
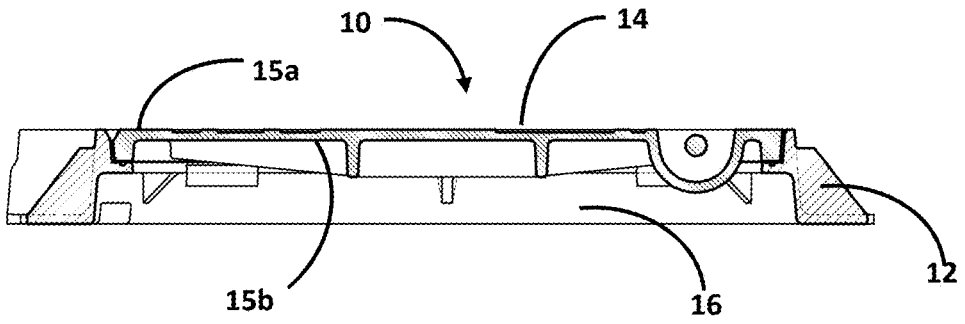
FIG. 1 illustrates a sectional side view of one embodiment of a closure assembly in accordance with the present disclosure.

The present disclosure relates to devices and methods providing cost-effective closure assemblies. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Figure 2:
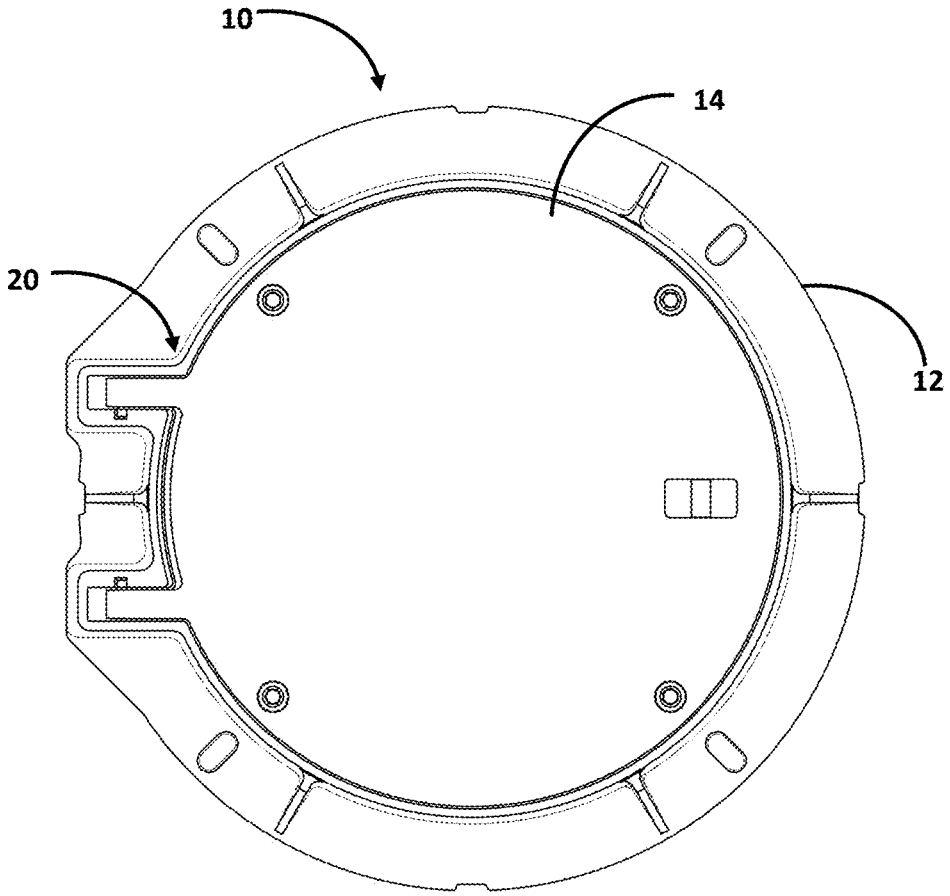
FIG. 2 illustrates a top view of the FIG. 1 embodiment.

Referring to FIG. 1, there is sectionally shown a closure assembly 10 that includes a frame 12 and a cover 14. The frame 12 may be configured to be set in a form-fitting manner onto an opening in the ground such as a channel arrangement, drainage channel, cable channel, shaft or similar structure (not shown in the drawing) that can be installed in the ground and selectively opened and closed. Referring to FIGS. 1 and 2, the cover 14 may be shaped and sized to fit onto a complementary opening 16 (FIG. 1) in the frame 12. While the frame 12, the cover 14, and the opening 16 are depicted as generally circular, other geometrical shapes may be used for any or all of these features, e.g., square, rectangular, oval, etc. The closure assembly 10 may be manipulated between a closed position and an opened position. Gravity may be the principal force that keeps the cover 14 closed over the frame 12. In the open position, gravity is used to prevent the cover 14 to rotate to the closed position. As further described below, a hinge assembly 20 may connect the cover 14 to the frame 12 and also allow the cover 14 to be completely disconnected from the frame 12.

Figure 3:
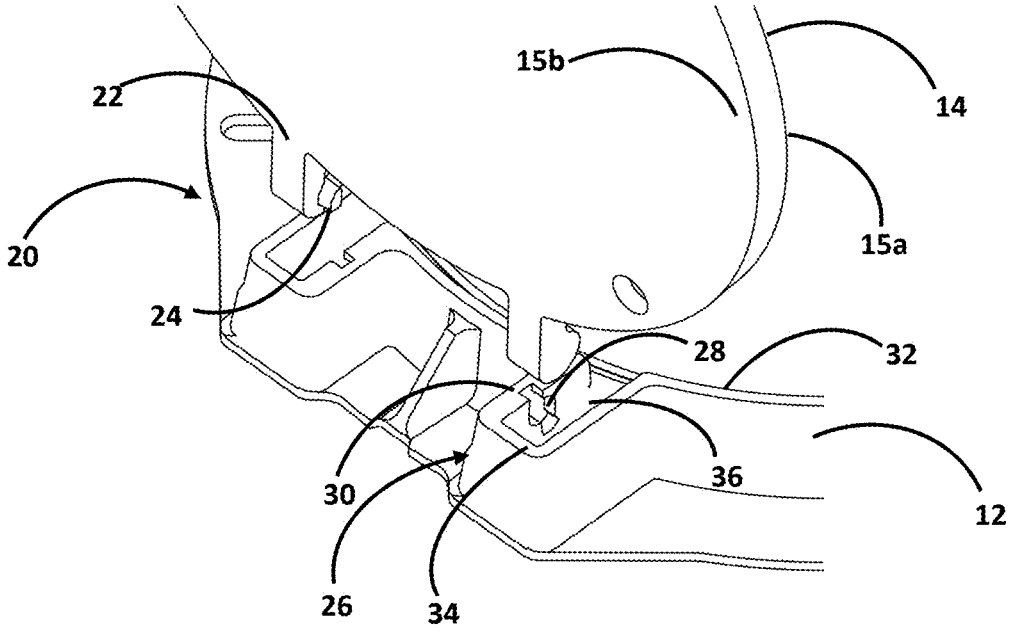
FIG. 3 illustrates a hinge assembly in accordance with one embodiment of the present disclosure.

Referring to FIG. 3, in one non-limiting embodiment, the hinge assembly 20 may include features formed on the cover 14 such as tines 22 and a projection 24 extending from each tine 22 and features formed on the frame 12 such as walls 26 and a slot 28 formed in each wall 26. The depicted embodiment uses two tines 22, each of which has an inwardly projecting projection 24; i.e., the projection 24 project toward one another from facing tine walls. Likewise, the embodiment uses two walls 26, each of which has a slot 28.

Other embodiments, not illustrated, may use one tine 22 or three or more tines 22. Also, each tine 22 may have two or more projections 24, which may project inwardly and/or outwardly. Outwardly projecting projections project from tine walls that do not face each other. Of course, such variations of tines 22 and projections 24 may have complementary walls 26 and slots 28.

In an arrangement, a pair of tines 22 may extend outwardly from the outer edge of the cover 14 and engage associated walls 26. The walls 26 may be formed as a U-shaped structure in a section of the frame 12. Each wall 26 may be formed of an inner wall 30, an outer wall 32, and a back wall 34. The walls 30, 32, 34 may be arranged to define a cavity 36 that is complementary in size and shape to the associated tine 22. In embodiments where the projections 24 extend toward one another as illustrated, each inner wall 30 may be formed with the slot 28. In embodiments (not shown) where the projections 24 extend away from one another, each outer wall 32 may be formed with the slot 28. In the illustrated embodiments, each tine 22 and projection 24 is a mirror image of the other, but other orientations may be used.

Figure 4:
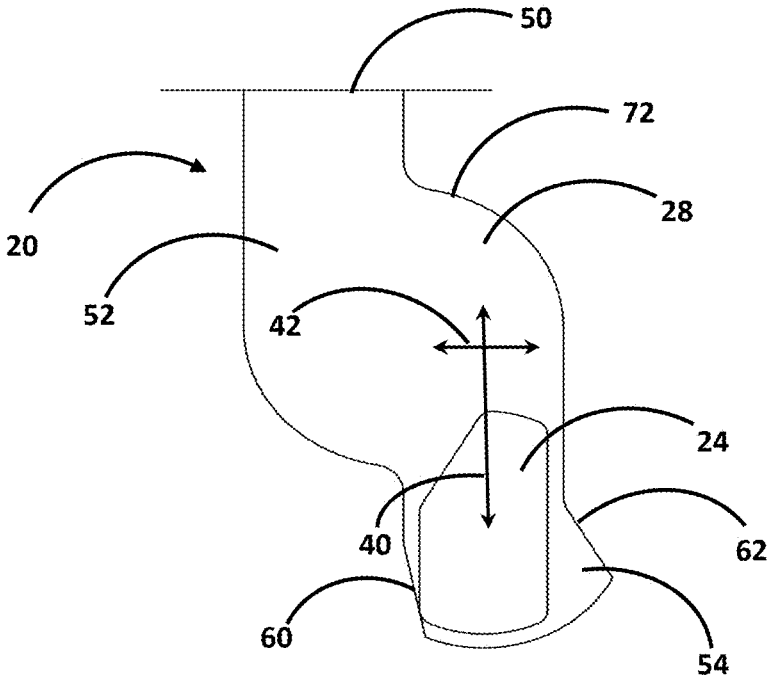
FIG. 4 illustrates engagement of a projection and a slot according to one embodiment of the present disclosure.

Referring to FIG. 4, there is illustrated a side view of a projection 24 that is engaged with a slot 28. The projection 24 may be a post, rod, cylinder or other protruding member and may incorporate ramps, flats, curvatures, bevels, or other features. For example, the projection 24 includes an angled flat and rounded ends. Each projection 24 may be defined by a length 40 and a width 42. The length 40 is generally coplanar with the upper and lower surfaces 15*a,b* (FIG. 3) of the cover 14. In embodiments, the slot 28, which may be a recess, depression, channel, groove, or cavity, may include an opening 50, a rotation section 52, and a locking section 54. As shown, the opening 50 and the locking section 54 each radiate from the rotation section 52. Thus, the projection 24 must pass through the opening section 50 before entering either rotating section 52 or the locking section 54. The opening 50 may be sized to accommodate the width 42 of the projection 24. The rotation section 52 may be sized to allow the projection 24 to rotate; e.g., the rotation section 52 may have vertical and horizontal dimensions that are larger than the length 40 of the projection 24. Thus, the projection 24 is sized to rotate within the rotation section 52. The locking section 54 may have a vertical distance selected to receive at least a portion of the length 40 of the projection 24. In one embodiment, the locking section 54 may be defined by a first angled surface 60 and a second angled surface 62, the angled surfaces 60, 62 may be considered opposing walls since they are not transverse to one another. The angled surfaces 60, 62 are separated by a distance that is larger than the width 42 of the projection 24. Further, the angled surfaces 60, 62 may have an angular offset that allows the cover 12 to rotate past the ninety degree orientation by a desired amount. It should be noted that in other embodiments, one or both of the surfaces 60, 62 may be vertical.

Figure 5A:
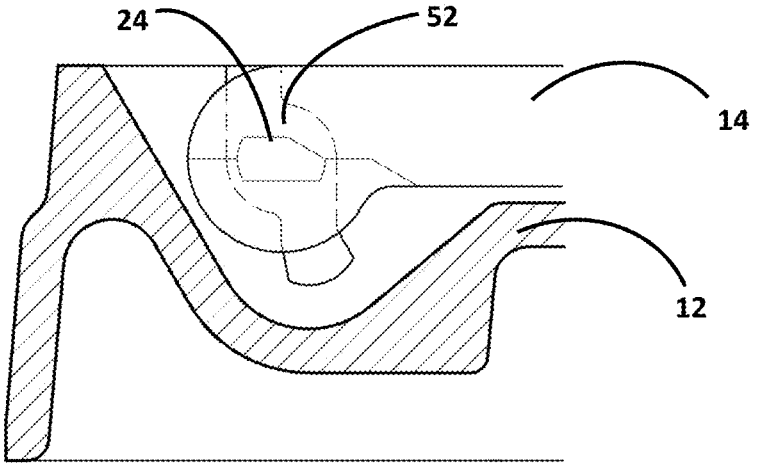
FIGS. 5A-C illustrates the various engagements of the FIG. 3 hinge assembly.
Figure 5B:
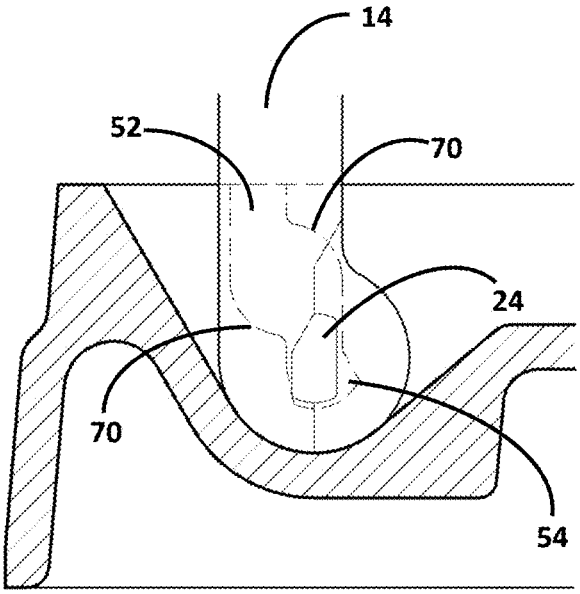

Further details of the projection 24 and the slot 28 will be described with reference to FIGS. 5A-C. In FIG. 5A, the cover 14 is seated on the frame 12, which seals the opening 16 (FIG. 1). The seal may or may not be watertight. If a watertight seal is desired, a suitable sealing member such as a gasket seal (not shown) may be used. In the closed position, the projection's length 40 (FIG. 4) is oriented horizontally and the projection 24 is completely inside the rotation section 52. In FIG. 5B, the cover 14 has been rotated approximately ninety degrees to a vertical orientation. In embodiments, the cover 14 may have a vertical resting angle between 86°-90° and inclined resting angle at 120°. The projection 24 acts as an axis of rotation for the cover 14 while sliding along the curved surfaces 70 defining the rotation section 52. After oriented in the vertical direction as shown, the projection 24 enters and is seated in the locking section 54. Once the projection 24 seats in the locking section 54, rotation of the cover 14 about the projection 24 is restricted in both rotational directions; i.e., opening and closing directions.

As best seen in FIG. 4, rotation in the closing direction is restricted by the first angled surface 60 and a vertical surface 72 defining a portion of the rotation section 52. In one arrangement, the first angled surface 60 and the vertical surface 72 are separated by a distance that is wider than the width 42 of the projection 24. Thus, the cover 14 can rotate to the closed position by a few degrees, e.g., up to about ten degrees, until one surface of the projection 24 contacts a portion of the vertical surface 72 and an opposing surface of the projection 24 contacts the first angled surface 60. After contact, gravity holds the cover 14 against the vertical surface 72 to maintain the open position.

Figure 5C:
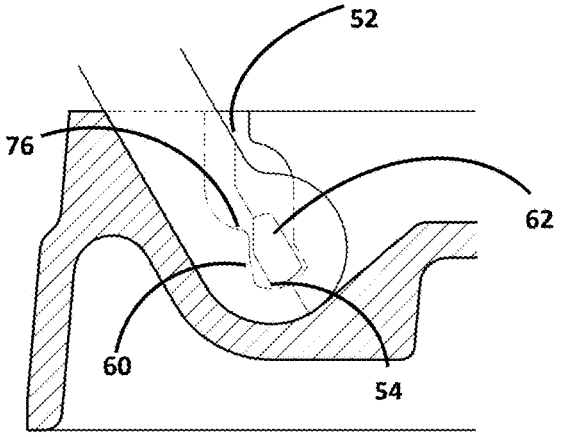

Referring to FIG. 5C, rotation of the cover 14 in the opening direction is restricted by the locking section 54. In arrangements, the angular misalignment between the vertical surface 60 and an angled surface 62 allows the cover 14 to rotate to a desired opened orientation that is greater than 90 degrees, e.g., 120 degrees. By angular misalignment, it is meant that the angled surfaces 60, 62 are not parallel to one another. Further rotation in the open direction is restricted by one surface of the projection 24 contacting the angled surface 62 and an opposing surface of the projection 24 contacting a ledge portion 76. The ledge portion 76 may be near a juncture of the rotation section 52 and the locking section 54.

Referring to FIG. 4, in embodiments, the opening 50, the rotation section 52, and the locking section 54 may incorporate a relative angular orientation that assists the operator during use. For example, the opening 50 and the locking section 54 may have a non-180 degree angular offset. By non-180 degree angular offset, it is meant that an object cannot move through the opening 50 and then through the locking section 54 in a single straight line, or vice versa. For example, when the projection 24 moves vertically upward from the locking section 54, the projection 24 contacts a non-vertical surface of the rotation section 52. This contact impedes further upward movement of the projection 24 in a straight line and indicates to the operator that the projection 24 is completely out of the locking section 54 and resides completely in the rotation section 52. Therefore, the cover 14 may be rotated into the closed position. It should be noted that if the opening 50 and the locking section 54 were vertically aligned, there is a risk the user may pull the projection 24 out of the locking section 54 and through the rotation section 52 and the opening 50. Alternatively, the cover 14 may be rotated until the projection 24 is aligned with the opening 50. Thereafter, the cover 14 may be pulled vertically upward and completely disconnected from the frame 12.

Figure 6A:
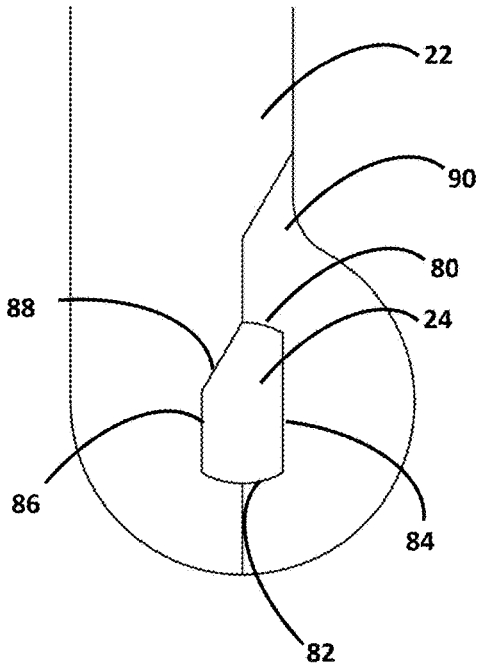
FIGS. 6A-B illustrates a non-limiting embodiment of a projection used in an hinge assembly in accordance with the present disclosure.
Figure 6B:
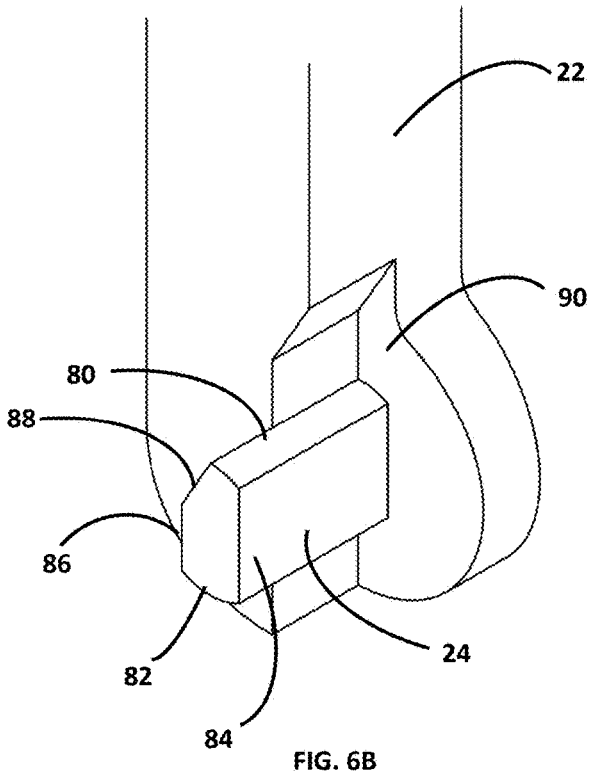

Referring to FIGS. 6A-B, there is shown one non-limiting embodiment of a tine 22 in accordance with the present disclosure. As discussed previously, the tine 22 may be a structural projection 24 that extends from a wall of the tine 22. While a tine 22 may use a simple shape such as a bar or cylinder shape, one or more geometric features may be incorporated for functions such as removal of accumulated debris or smoother physical interactions (e.g., between sliding surfaces). In the embodiment illustrated, the projection 24 may be formed as a rectangular bar that include ends 80, 82 that may be rounded and lateral surfaces 84, 86, and 88. Lateral surface 88 may be an inclined. Additionally, the projection 24 may be positioned at least partially in a recess 90 formed in the tine 22.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

We claim:

1. A closure assembly, comprising:
a frame;
a cover; and
a hinge assembly selectively connecting the frame to the cover, wherein the hinge assembly is configured to allow the cover to rotate between an open position and a closed position, and wherein the hinge assembly includes:
at least one tine formed on an edge of the cover,
a projection extending from the at least one tine, wherein the projection is defined by a length and a width,
at least one wall formed on an upper surface of the frame, and
a slot formed in the at least one wall and configured to receive the projection, wherein the slot includes a rotation section, an opening radiating from the rotation section, and a locking section radiating from the rotation section,
wherein the length of the projection is oriented horizontally when the projection is completely inside the rotation section, and wherein the projection is configured to enter the locking section only after rotated to a vertical position,
wherein the locking section is configured to allow the cover to rotate to an angle greater than ninety degrees when the projection is at least partially in the locking section, and
wherein the locking section and the opening have a non-180 degree angular offset relative to one another.

2. The closure assembly of claim 1, wherein the rotation section is defined by a first non-vertical surface positioned vertically above the locking section.

3. The closure assembly of claim 2, wherein the rotation section is defined by a second non-vertical surface positioned vertically below the opening.

4. The closure assembly of claim 1, wherein the projection is positioned at least partially in a recess formed in the at least one tine.

5. The closure assembly of claim 1, wherein the locking section is defined by a vertical surface of a first wall and a non-vertical surface of a second wall that opposes the first wall, wherein the first wall and the second non-vertical surface of the second wall are configured to restrict rotation of the cover to a selected angle.

6. The closure assembly of claim 5, wherein further rotation to the open position is restricted by contact between the projection and the non-vertical surface of the second wall.

7. A closure assembly, comprising:
a frame;
a cover; and
a hinge assembly connecting the frame to the cover, wherein the hinge assembly includes:
a first and a second tine formed on an edge of the cover,
a projection extending from each of the first tine and the second tine, wherein each projection is defined by a length and a width,
a first and a second wall formed on an upper surface of the frame, and
a slot formed in the each of the first wall and the second wall,
wherein each slot includes an opening, rotation section, and a locking section, and
wherein:
each opening is configured to allow passage of the associated projection into and out of the associated rotation section,
each rotation section is configured to allow rotation of the associated projection, wherein the length is coplanar with upper and lower surfaces of the cover when the cover is in the closed position, and
each locking section is defined by a vertical surface and an angled surface, wherein the vertical surface and the angled surface are separated by a distance that is larger than the width of the associated projection,
wherein the vertical surface and the angled surface are non-parallel such that the cover can rotate greater than ninety degrees while each projection is at least partially in the associated locking section,
wherein the rotation of the cover is restricted to a selected angle by a first surface of the associated projection engaging the vertical surface and a second surface of the associated projection engaging the angled surface.

8. The closure assembly of claim 7, wherein each rotation section is defined by a first non-vertical surface positioned vertically above the associated locking section.

9. The closure assembly of claim 8, wherein each rotation section is defined by a second non-vertical surface positioned vertically below the opening.

10. The closure assembly of claim 7, wherein each projection is configured to rotate within the associated rotation section.

11. The closure assembly of claim 7, wherein each locking section is defined by a vertical surface of a first wall and a non-vertical surface of a second wall that opposes the first wall.

12. The closure assembly of claim 11, wherein further rotation to the open position is restricted by contact between each projection and the associated non-vertical surface of the associated second wall.

13. The closure assembly of claim 7, wherein further rotation to the closed position is restricted by contact between each projection and a vertical surface defining the associated locking section and a vertical surface defining a portion of the associated rotation section.

* * * * *